US007096507B1

(12) United States Patent
Bolden

(10) Patent No.: US 7,096,507 B1
(45) Date of Patent: Aug. 29, 2006

(54) FULL LEG JOINT PAD APPLIANCE

(76) Inventor: Ira Bolden, 2861 NW. 15th Ct., Apt. 2, Ft. Lauderdale, FL (US) 33311

( * ) Notice: Subject to any disclaimer, the term of this patent is extended or adjusted under 35 U.S.C. 154(b) by 0 days.

(21) Appl. No.: 11/155,695

(22) Filed: Jun. 17, 2005

Related U.S. Application Data

(60) Provisional application No. 60/582,040, filed on Jun. 22, 2004.

(51) Int. Cl.
*A41D 13/00* (2006.01)

(52) U.S. Cl. ..... 2/22; 2/455; 2/23; 2/24; 2/62; 2/231; 2/242; 2/267; 2/908; 2/911; 602/23; 602/26; 602/62

(58) Field of Classification Search ..... 2/455, 2/22, 23, 24, 62, 231, 242, 267, 908, 911; 602/23, 26, 62
See application file for complete search history.

(56) References Cited

U.S. PATENT DOCUMENTS

| | | | | | |
|---|---|---|---|---|---|
| 3,585,639 | A * | 6/1971 | Enicks | 2/22 |
| 3,735,419 | A | 5/1973 | Byrd | |
| 4,371,985 | A | 2/1983 | Pokhis | |
| D272,281 | S * | 1/1984 | Alush | D24/192 |
| 4,497,070 | A * | 2/1985 | Cho | 2/22 |
| 4,608,718 | A * | 9/1986 | Reed | 2/22 |
| 4,641,639 | A * | 2/1987 | Padilla | 602/23 |
| 4,772,071 | A | 9/1988 | Richards | |
| 5,020,523 | A * | 6/1991 | Bodine | 602/27 |
| 5,073,986 | A * | 12/1991 | Farrago | 2/22 |
| 5,183,036 | A * | 2/1993 | Spademan | 602/10 |
| 5,250,021 | A * | 10/1993 | Chang | 602/27 |
| 5,697,893 | A * | 12/1997 | Rhenter | 602/27 |
| 5,865,778 | A * | 2/1999 | Johnson | 602/27 |
| 5,944,678 | A * | 8/1999 | Hubbard | 602/27 |
| 6,298,508 | B1 | 10/2001 | McCloskey | |
| 6,299,587 | B1 * | 10/2001 | Birmingham | 602/5 |
| 6,350,246 | B1 * | 2/2002 | DeToro et al. | 602/27 |
| D463,886 | S | 10/2002 | Cantu, Jr. | |
| 6,578,217 | B1 | 6/2003 | Roberson | |
| 6,654,962 | B1 | 12/2003 | DeMott | |
| 6,827,696 | B1 * | 12/2004 | Maguire | 602/27 |

* cited by examiner

*Primary Examiner*—Henry Bennett
*Assistant Examiner*—Nihir Patel
(74) *Attorney, Agent, or Firm*—Randal D. Homburg

(57) ABSTRACT

A lower leg appliance provides padding and cushion support for the knee, ankle and hip joints in the leg, by providing a hard surfaced knee pad, a hard surfaced ankle pad and a soft surface calf and thigh pad positioned between the calf and thigh, held in place by at least three adjustable straps having a closure means, the three pads working in conjunction to provide relief and support to a persons knees, ankles and hips while squatting or kneeling during chores, activities or labor.

1 Claim, 3 Drawing Sheets

FULL LEG JOINT PAD APPLIANCE

CROSS REFERENCE TO RELATED APPLICATIONS

I. BACKGROUND OF THE INVENTION

1. Field of Invention

A lower leg appliance provides padding and cushion support for the knee, ankle and hip joints in the leg, by providing a hard surfaced knee pad, a hard surfaced ankle pad and a soft surface calf and thigh pad positioned between the calf and thigh, held in place by at least three adjustable straps having a closure means, the three pads working in conjunction to provide relief and support to a persons knees, ankles and hips while squatting or kneeling during chores, activities or labor.

2. Description of Prior Art

The following United States patents are identified and disclosed herein. Several devices are disclosed relating to leg pads and supports.

In two U.S. Pat. Nos. 5,073,986 to Farrago and 4,371,985 to Pokhis, a strap-on pad is disclosed which is placed on the back of the calf of the lower leg which provides a cushion for a person squatting which is oriented between the calf and back of the thigh, with Pokhis being an inflatable cushion and Farrago being a flexible enclosure with a flexible and resilient filling. These do not provide a knee cushion or an ankle cushion in the same apparatus. A set of leggings is disclosed in U.S. Pat. No. 6,654,962 to DeMott, which has a padded knee portion and is worn over pants.

A kneeling cushion is disclosed in U.S. Pat. No. 6,298,508 to McClosky and appears to be a solid apparatus with openings for placing the feet through, while providing a cushion for the lower legs and another attached cushion between the calf and thigh portion of the legs. U.S. Pat. No. 6,578,217 to Roberson also discloses a similar device, except that it has the pads separate and is carried by a shoulder strap.

U.S. Pat. No. 4,772,071 to Richards discloses a very complex mechanical device which include lower knee pads each having a first section attached to a lower leg and provided with a knee seat accommodation for the upper end of the tibia and a second section connected to the first section and provided with a seat engagable by a buttocks and a portion of the associated upper leg when the wearer kneels. Each knee pad also includes a support engagable with the floor or other surface on which the wearer kneels and which has the function of bearing the weight of the wearer's body and helps avoid strain to the flexed knee. An adjustment along the lower portion also elevates the toes and foot above the kneeling surface, with the first and second sections being length adjustable with pins to hold the device in a kneeling position which are released to stand up.

Strap-on knee and shin guards are disclosed in U.S. Pat. Nos. D462,886 to Cantu, Jr. and 3,735,419 to Byrd, which cover and protect the shin and knee of the wearer, as commonly used by catchers in baseball games.

II. SUMMARY OF THE INVENTION

When kneeling or squatting, a great deal of stress and strain is realized upon the joints of the leg and lower body. There are three primary joints affecting the legs, including the hips, knees and ankles. During tasks involved in chores or labor, kneeling and squatting is often required, with some tasks requiring a great deal of time in one position. This causes enhanced stress on the joints and leads to stiffness and discomfort over long periods of time. It can also lead to degeneration of the joints which require medical care and treatment and accelerate the onset of degenerative disease. There have been pads and cushions provided to apply to single joints and some even having use to more than one areas. However, no singular appliance has addressed all the major joints in the leg affected by squatting or kneeling.

The present appliance cushions the knee joint, the ankle joint and provides cushion between the calf and buttock to cushion the hips while in the squatting or kneeling position. It is therefore the primary objective of the appliance to provide and single appliance worn on the lower leg to cushion the ankle, knee and hip joints. A second objective is to provide the appliance with a means of applying the appliance to the leg using adjustable strap connections which may be applied and removed from a standing or seated position. A third objective would be providing the appliance to attach onto the lower leg with a plurality of adjustable straps, with firm support on the pads engaging the ground or hard surface and a soft surface pad between the calf and thigh areas.

III. DESCRIPTION OF THE DRAWINGS

The following drawings are informal drawings submitted with this provisional patent application.

IV. DESCRIPTION OF THE PREFERRED EMBODIMENT

Figure 1:
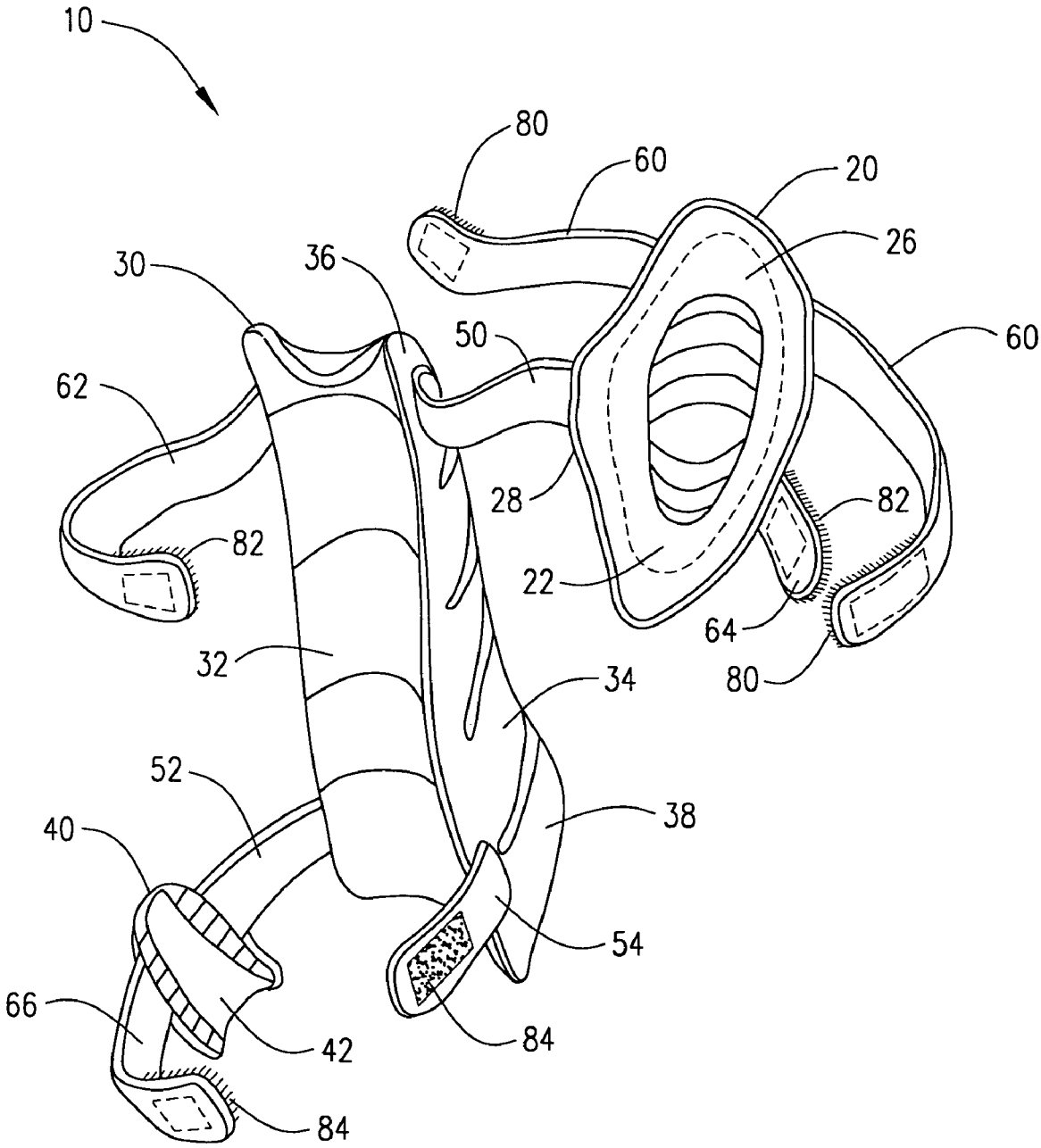
FIG. 1 is a perspective view of the appliance.
Figure 2:
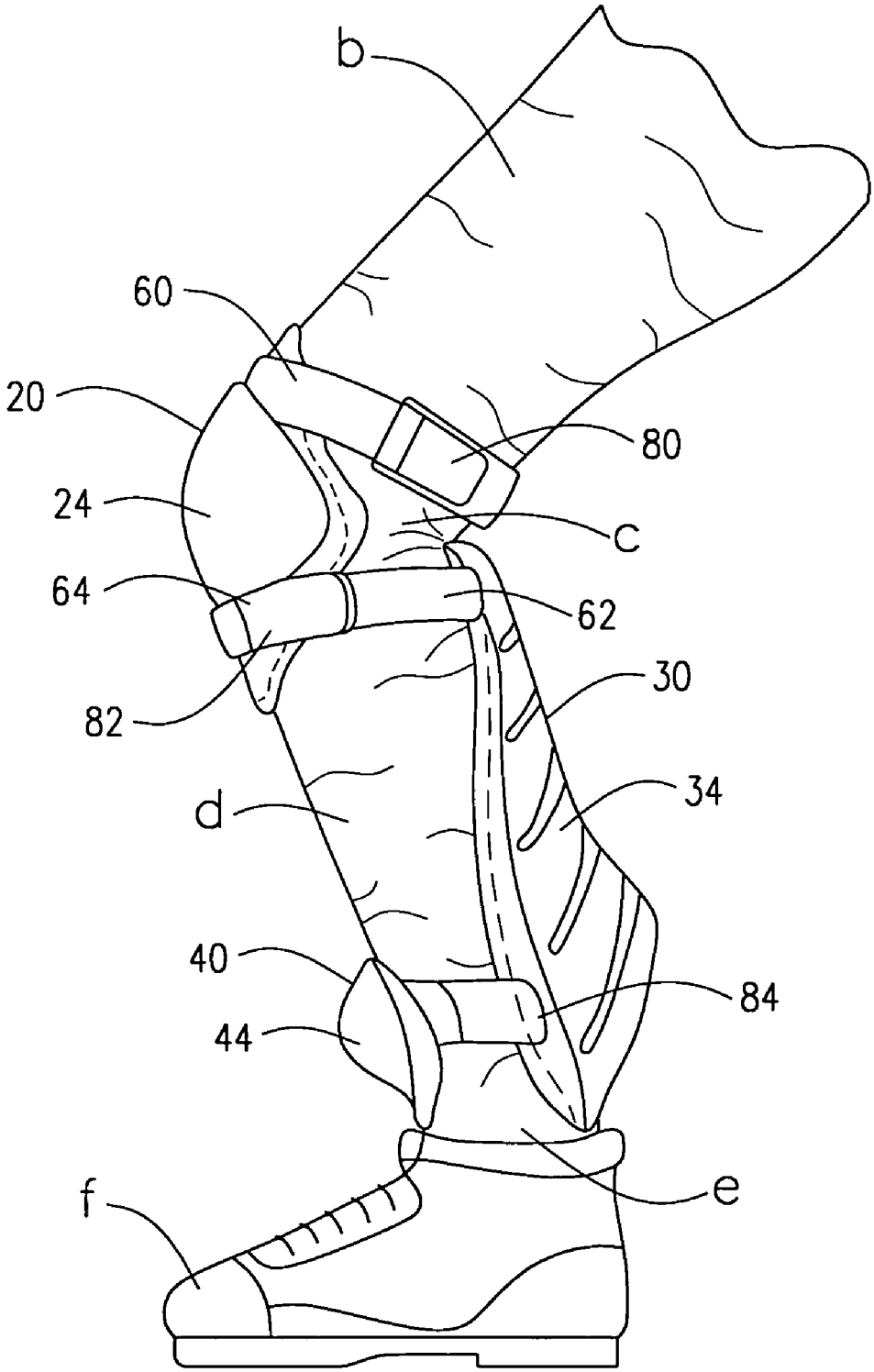
FIG. 2 is a side view of the appliance applied to a leg in a standing position.
Figure 3:
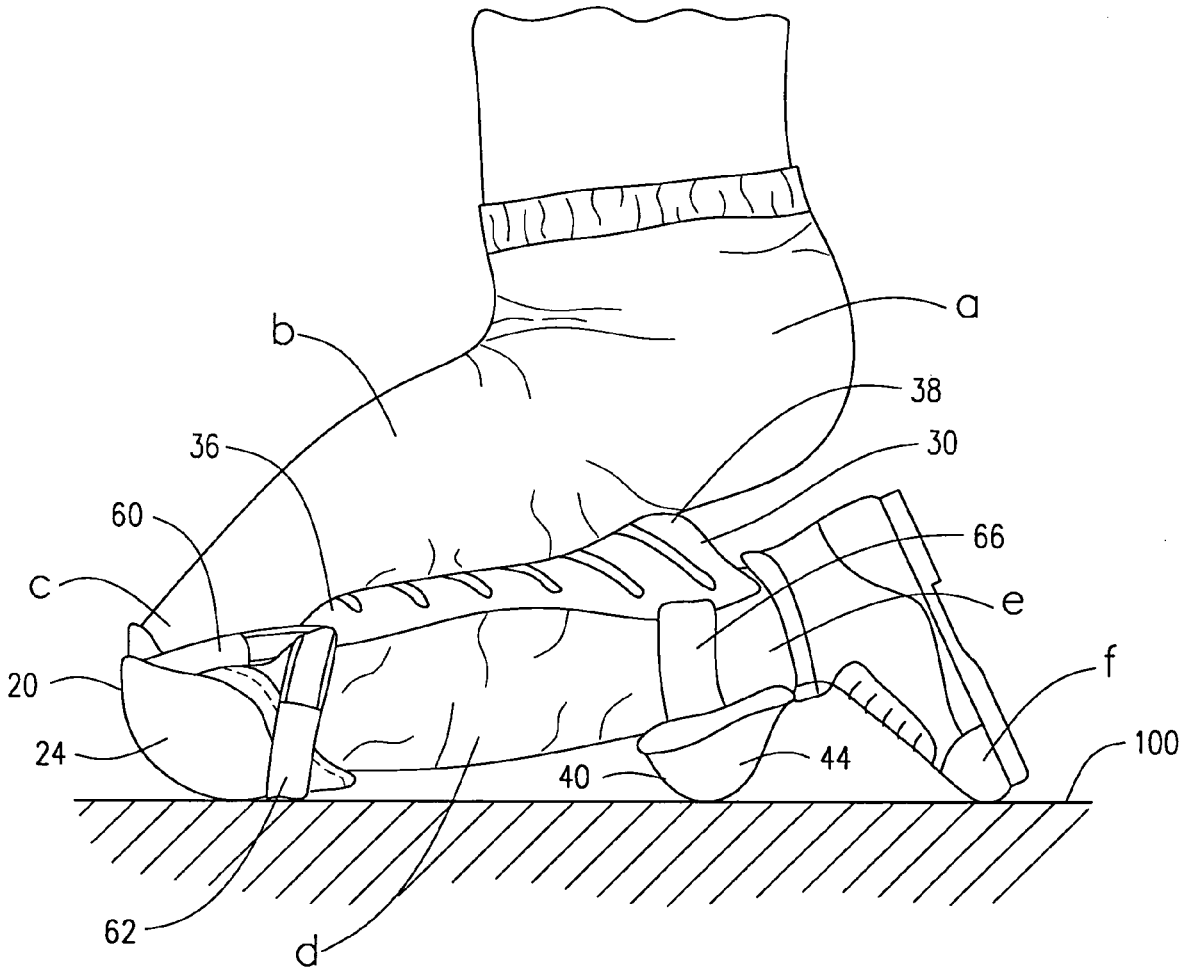
FIG. 3 is a side view of the joint pad appliance in use during a kneeling task.

A joint pad appliance 10 aches to a lower leg of a person during a squatting or kneeling task to protect and provide padding simultaneously to the hips a, thighs b, knees c and ankles e of a human body, as shown in FIGS. 1–3 of the drawings. The appliance 10 comprises a knee pad 20 having a padded concave inner surface 22 adapted to the knee c of a leg and a convex and hardened outer surface 24, a calf pad 30 having a concave longitudinal inner surface 32 adapted to the calf d of a lower leg and a concave longitudinal outer surface 34 adapted to the back of the thigh b, and an ankle pad 40 having a padded concave inner surface 42 adapted to the top of an ankle e and a hardened and extended outer surface 44 which projects outward. The knee pad 20, calf pad 30 and ankle pad 40 are attached to the legs by a plurality of elastic straps 50, 52, 54 and elastic bands 60, 62, 64, 66 having respective adjustable closure means 80, 82, 84.

More specifically, a lower portion 28 of the knee pad and an upper portion 36 of the calf pad are connected together by a first elastic strap 50 and the lower portion 38 of the calf pad 30 and ankle pad 40 are connected together by a second elastic strap 52. A first set of elastic bands 60 are attached to an upper portion 26 of the knee pad 20 and are connected by a first adjustable closure means 80 behind the knee c. A second elastic band 62 is attached to the upper portion 36 of the calf pad 30 and connects to a third elastic band 64 attached to the lower portion 28 of the knee pad 20 by a second adjustable closure means 82. A fourth elastic band 66 attaches the ankle pad 40 to a tab strap 54 extending from the lower portion 38 of the calf pad 30 by a third adjustable closure means 84.

When positioned upon the a leg in a standing position, as shown in FIG. 2, the knee pad 20 should be centered over the knee c, the calf pad 30 should be positioned against the calf d and the ankle pad 40 should be in front of the ankle e. When kneeling, as shown in FIG. 3, the ankle pad 40 should be between a kneeling surface 100 and the ankle e, supporting the ankle e above the ground to relieve stress on the toes f or tips of the feet, the knee pad 20 should be in contact with the kneeling surface 100 and the calf pad 30 should be between the calf d and the back of the thigh b, providing a cushion to both the calf d and the thigh b.

The hardened outer surface 24 of the knee pad 20 could be made of a hard plastic, leather, a hard rubber or metal, with the padded inner surface 22 made of a compression foam rubber material. The calf pad 30 would preferably be made of a soft foam rubber with an outer vinyl or rubber encasement. The ankle pad 40 would preferably provide the padded concave inner surface 42 made of a compression foam rubber material with the hardened and extended outer surface 44 made of a hard plastic, leather, a hard rubber or metal.

The first, second and third adjustable closure means 80, 82, 84 could be a hook and loop fabric, a buckle on one band and a series of holes in the other band or a plastic male and female connector connected to ends of each band in each set.

The first and second elastic straps 50, 52 must be flexible to allow for movement during repeated standing and kneeling, but resilient to retain the knee, calf and ankle pads 20, 30, 40 where they remain positioned over their respective joints and behind the calf without having to reposition the pads on the protected areas of the lower legs.

Use for the appliance would be found with those whose vocation or recreation include bending and kneeling on hard surfaces, including floor installation workers, gardeners, auto shop workers, geologists, archeologists and cleaning personnel, although some sporting activities might find the appliances useful in protection of joints against hard impact.

Although the embodiments of the invention have been described and shown above, it will be appreciated by those skilled in the art that numerous modifications may be made therein without departing from the scope of the invention as herein described.

I claim:

1. A joint pad appliance attaches to a lower legs of a person during a squatting or kneeling task to protect and provide padding simultaneously to the hips, thighs, knees and ankles of the lower legs, each appliance, comprising:

a knee pad having a padded concave inner surface adapted to the knee and a convex and hardened outer surface, a calf pad having a concave longitudinal inner surface adapted to the calf and a concave longitudinal outer surface adapted to the thigh, and an ankle pad having a padded concave inner surface and a hardened and extended outer surface which projects outward from the ankle, each said knee pad, calf pad and ankle pad attached to the lower leg by a plurality of elastic straps and elastic bands having respective closure means said plurality of elastic straps and elastic bands further comprising, a first elastic strap connecting a lower portion of said knee pad to an upper portion of said calf pad a second elastic strap connecting a lower portion of said calf pad to said ankle pad a first set of elastic bands attached to an upper portion of the knee pad connected together by a first closure means behind the knee a second elastic band attached to said upper portion of the calf pad, said second elastic band further connecting to a third elastic band attached to said lower portion of said knee pad by a second closure means and a fourth elastic band attaching said ankle pad to a tab strap extending from said lower portion of said calf pad by a third closure means.

* * * * *